US005690588A

United States Patent [19]

Lavore

[11] Patent Number: 5,690,588

[45] Date of Patent: Nov. 25, 1997

[54] UNDERWATER AQUACYCLE

[76] Inventor: Joseph S. Lavore, 6492 Sugar Tree Dr., Spring Hill, Fla. 34607

[21] Appl. No.: 808,876

[22] Filed: Feb. 28, 1997

[51] Int. Cl.[6] ..... A63B 21/008

[52] U.S. Cl. ..... 482/58; 482/111

[58] Field of Search ..... 482/51, 52, 53, 482/57, 58, 111, 112, 908; 119/700, 702

[56] References Cited

U.S. PATENT DOCUMENTS

| | | | |
|---|---|---|---|
| 4,162,788 | 7/1979 | Turnier | 482/58 |
| 5,135,448 | 8/1992 | Dunn et al. | 482/53 |
| 5,354,253 | 10/1994 | Anbrey et al. | 482/111 |
| 5,399,134 | 3/1995 | Abboudi et al. | 482/111 |
| 5,487,713 | 1/1996 | Butler | 482/111 |
| 5,586,961 | 12/1996 | Quint | 482/111 |

*Primary Examiner*—Stephen R. Crow
*Attorney, Agent, or Firm*—American Innovations, Inc.; Dorothy Morse, Esq.

[57] ABSTRACT

An underwater apparatus for exercising muscles associated with a person's legs and feet which has an adjustable seat and a U-shaped configuration which allows it to be reoriented within a body of water for use in alternatively exercising muscles associated with a person's shoulders and upper extremities. Paddles are removably attached to a pair of spaced-apart wheels mounted laterally on one end of the U-shaped frame, while a vertically adjustable seat is connected to the other end of the U-shaped frame. A weight anchors the frame securely into a fixed position against the bottom of the body of water in which the apparatus is used. Paddles are each attached to the perimeter of one or both of the wheels by a casing so that each paddle extends radially beyond the perimeter of the wheel to which it is attached. Since the wheels operate independently from one another and the paddles are each changeable in orientation relative to the wheels, the wheels can offer the same or differing mounts of resistance during exercise. The U-shaped frame is also adjustable in length to accommodate operators of differing stature. Applications may include, but are not limited to, use by athletes for training purposes, as well as use by athletes and others for rehabilitative purposes.

12 Claims, 4 Drawing Sheets

UNDERWATER AQUACYCLE

BACKGROUND—FIELD OF INVENTION

This invention relates to variable resistance underwater exercise devices, specifically to a variable resistance underwater apparatus comprising two spaced-apart rotating wheels each with plurality of removable paddles attached thereto which radially extend beyond the perimeter of the wheels, an adjustable seat, and an adjustable U-shaped frame for supporting the wheels and the seat. The apparatus, when positioned within a body of water in a first orientation with the seat supporting member and the wheel supporting portion of its U-shaped frame perpendicular to the bottom of the water, and with its seat attached to the frame, allows an operator positioned on the seat to use his or her feet to rotate the wheels for exercise of muscles associated with his or her lower extremities. Since the wheels operate independently and each of the paddles are changeable in orientation relative to the wheels, the wheels can offer differing amounts of resistance during exercise to muscles on opposite sides of an operator's body for rehabilitative use. When the frame is rotated ninety degrees and placed into a second orientation with the seat supporting member of the U-shaped frame positioned to rest upon the bottom of the water, and with the seat removed, the wheels of the apparatus can be used by an operator standing on the seat supporting member to exercise muscles associated with his or her upper extremities. Applications may include, but are not limited to, use by athletes for training purposes, as well as use by athletes and others for rehabilitative purposes.

BACKGROUND—DESCRIPTION OF PRIOR ART

Variable resistance underwater exercise devices are known. The invention in U.S. Pat. No. 5,354,253 to Awbrey (1994) discloses a fitness, exercise, and rehabilitative device which is adjustable in height, attaches to the side of the pool or a pool ladder, and has a variety of attachments for performing exercises such as, but not limited to, sit-ups, pull-ups, leg extensions, and cycling. A water inertial fan is connected to a sprocket and pedals for the cycling type of exercise. Handles configured like the handle bars of a bicycle and a seat are also used for the cycling portion of the exercises possible during use of the Awbrey invention. The angle of attack of the fan blade, gearing, and surface area can be adjusted to provide variable resistance during exercise. In contrast, the present invention is anchored to the bottom of a body of water, not attached to the side of a pool, and the present invention comprises two spaced-apart rotating components, one independently attached to each pedal, instead of the one inertial fan used by the Awbrey invention. Also, the adjustable U-shaped frame of the present invention is different in configuration from the frame of the Awbrey invention in that the U-shaped frame of the present invention can be rotated to re-position its wheels for upper extremity exercise use without the need for an assortment of attachments. Further, the handles used for upper extremity exercise in the present invention are each connected laterally to one of the pedals, the pedals being removable during use of the handles, if desired. This allows a standing operator to place his or her arms in a comfortable position for upper extremity exercise. The present invention also has an advantage of being less complex than the Awbrey invention, since the present invention does not comprise an assortment of removable attachments for use by an operator to perform a variety of exercises. Further, since the pedals of the present invention operate independently from one another, in contrast to the pedals of the Awbrey invention, the present invention can provide different mounts of resistance simultaneously for different levels of exercise by muscles on opposite sides of an operator's body a feature particularly useful for rehabilitative use so that a person's stronger arm or leg does not have to exercise at the lower resistance level needed for his or her weaker arm or leg.

A variable resistance underwater exercise device comprising a rotating component with paddles is disclosed in U.S. Pat. No. 4,249,725 to Mattox (1981). The Mattox invention comprises a rotor driven by chains and sprockets connected to an operating lever which is repeatedly moved in an upward direction on the shoulders of an operator. The inertia of the spinning rotor causes the operator to constantly accelerate during the exercising stroke. Movable paddles are attached to the ends of the operating lever and changed in position radially inward and outward to vary resistance. The Mattox invention differs from the present invention in that the present invention comprises an adjustable U-shaped frame anchored to the bottom of a body of water. Also, the muscle movement of an operator using the present invention involves the movement and extension of upper and lower extremity muscles required to rotate a wheel, not the repeated upward and downward movement of an operator from a squatting position to lift a operating lever. Also the present invention comprises two spaced-apart rotating components instead of the one rotor used by the Mattox invention. Further, it is contemplated for the U-shaped frame of the present invention to be rotated to reposition the height of its wheels for alternative use in exercising muscles associated with the upper and lower extremities. Also, the present invention has an advantage of being less complex than the Awbrey invention, since the present invention does not comprise an assortment of chains and sprockets functioning to translate movement from an operating lever to a rotor. In addition, the present invention would have a rehabilitative advantage over the Mattox invention since the pedals of the present invention operate independently from one another and different mounts of resistance can be used simultaneously to provide different levels of exercise to muscles on opposite sides of an operator's body.

Another underwater exercise device is disclosed in U.S. Pat. No. 4,759,544 to Diaz (1998). The Diaz invention comprises a fluid enclosure and an exercise platform secured to the raised bottom center portion of the enclosure. The exercise platform comprises a rotating lever arm having a foot pedal attached to each of its ends. As an operator performs a back and forth rocking movement while positioned with his or her feet on the pedals, the repeated stepping forward and downward onto the right foot pedal, then backward and downward onto the left foot pedal causes the operator's center of gravity to alternately shift forward and backward. Currents and turbulence thus created in the fluid medium around the operator provides a massaging action for the operator. The Diaz invention differs from the present invention in that the present invention has two rotating wheels which an operator can use to create muscle extension and movement, in contrast to a single lever arm having foot pedals attached thereto. Also, the present invention comprises paddles removably attached to its wheels, the paddles being changeable in orientation so as to vary the water resistance of each rotating wheel. Since the wheels are each operated independently from the other, each wheel can provide a different level of exercise resistance. The present invention also has an adjustable U-shaped frame which can rotated between two distinct orientations ninety degrees from one another, so that the same basic apparatus, with the exception of an adjustable seat, is alternatively used to exercise muscles associated with upper and lower extremities.

The prior an thought to be most closely related to the present invention is the invention disclosed in U.S. Pat. No. 5,487,713 to Butler (1996). The Butler invention comprises a water-filled treatment vessel designed with anti-splash features and an adjustable exercise device having a pedal assembly connected to a series of concentrically interconnected discs. The pedal assembly is attached to a frame that is suspended into the treatment vessel by a cantilevered wheel support member. Its frame is adjustably connected to the wheel support member and is also adjustable in length to provide maximum benefit to persons of differing stature. Incrementally spaced receptors along radii in each disc removably receive a user's lower extremities and allow each lower extremity to achieve a different path of travel. Alternately, handlebars which communicate with the pedal assembly can be used to drive the concentric discs. The Butler invention also comprises a water-powered piston assembly attached to the cycle component to provide effortless movement of a user in and out of the treatment vessel. The present invention differs from the Butler invention in that the present invention provides variable resistance for a user through changes in paddle orientation between a vertical position and a horizontal position. It also has an advantage of providing a more compact configuration which is more easily applied for use in residential or community swimming pools. Also, the U-shaped frame of the present invention, with its ability to be rotated ninety degrees to provide alternative muscle exercise, is distinct from the Butler invention. It is not known to have a variable resistance underwater apparatus which has a pair of independently rotating spaced-apart wheels each with a plurality of paddles removably attached thereto, a vertically adjustable seat, and an adjustable U-shaped frame for supporting the wheels and seat, the underwater apparatus, when placed into a first orientation with its seat supporting member and the wheel supporting portion of its U-shaped frame perpendicular to the bottom of the water, allowing an operator positioned on the seat to use his or her feet to rotate the independently operated wheels for exercise of muscles associated with his or her lower extremities, and when the underwater apparatus is positioned within a body of water in a second orientation, with its frame rotated ninety degrees from the first orientation, with the seat removed from its frame, and the seat supporting member of the U-shaped frame positioned to rest on the bottom of the water, the apparatus allowing an operator standing on the seat supporting member to exercise muscles associated with his or her upper extremities.

SUMMARY OF INVENTION—OBJECTS AND ADVANTAGES

It is the primary object of this invention to provide an underwater exercise device for use in exercising the muscles associated with a person's lower extremities which is easily convertible into an underwater exercise device for alternative use in exercising the muscles associated with a person's upper extremities. It is also an object of this invention to provide a variable resistance underwater exercise device. A further object of this invention is to provide an underwater exercise device with two wheels which can each rotate independently from one another in both clockwise and counterclockwise directions. It is also an object of this invention to provide an underwater exercise device which remains anchored in a stable position during use.

As described herein, properly manufactured and positioned for use within a body of water, the present invention would provide an exercise device having a U-shaped frame comprised of two L-shaped components, one movable relative to the other, one of the L-shaped components having a seat supporting member on one of its ends, and the other L-shaped component having a wheel supporting portion on one of its ends. The exercise device would also comprise two rotatable wheels and a plurality of paddles attached to the perimeter of each wheel, the paddles extending radially beyond the wheel's perimeter. The wheels would each rotate about a central axis as a result of movement by an operator's feet against a pedal connected thereto, or an operator's hands against a handle positioned laterally to each pedal. Since the wheels operate independently and the paddles are each changeable in orientation between a vertical position and a horizontal position, the wheels can offer the same or differing amounts of resistance during exercise to muscles on opposite sides of an operator's body. Lock buttons having spring means associated therewith secure paddles into various orientations within a casing, between a vertical position and a horizontal position. It is contemplated for a weight to secure the frame of the underwater exercise invention and anchor it in a stable position against the bottom of a swimming pool, or other body of water of sufficient depth to at least submerge a portion of the wheels. It is also contemplated for the wheel of the underwater exercise invention to rotate in both clockwise and counterclockwise directions. During use to exercise muscles associated with an operator's lower extremities, the operator would position the U-shaped frame of the underwater exercise invention so that the seat supporting member and the wheel supporting portion of its U-shape are positioned perpendicular to the bottom of the body of water. A removable weight placed within a recess in the frame would securely anchor the U-shaped frame in a fixed position during use. The operator would sit upon a seat removably attached to the seat supporting member of the U-shaped frame and a seat belt would maintain the operator upon the seat during exercise. Holes through the both seat and the seat supporting member, and telescoping seat legs, would allow the seat to be vertically adjustable relative to the frame to accommodate people of different stature. One of the L-shaped components of the U-shaped frame is movable relative to the other to offer operators a range of leg extension and movement and for adjustment to accommodate people of differing stature. During exercise, heel plates and straps would secure a seated operator's feet against pedals so that each wheel could be moved in both clockwise and counterclockwise directions. As the resistance of the wheels would need to be varied to meet changing needs of an operator, the orientation of each paddle relative to its attached wheel can be changed independently from the paddles on the other wheel to offer the operator different levels of resistance to opposite extremities. This is extremely advantageous for rehabilitative use, such as rehabilitation of a post fractured arm or leg, since a stronger extremity would not have to be exercised at the lower level of resistance best suited for an opposed weaker extremity. After exercise of muscles associated with lower extremities, should an operator want to exercise muscles associated with upper extremities, the operator would remove the weight from the frame, rotate the frame ninety degrees so that the seat supporting member of its U-shaped frame is positioned against the bottom of the pool or treatment vessel. After removal of the seat, readjustment of the L-shaped components lengthwise relative to one another when necessary, and replacement of the weight within the recess in the frame to anchor the frame to the bottom of the body of water, the operator can stand upon the upper surface of the seat supporting member and grip one or both handles with his or her hands to cause each wheel to rotate about its central axis to obtain the level of upper extremity exercise desired. The pedals are removable from their positions adjacent to the handles should an operator be more comfortable in doing so for handle use. It is also contemplated for the wheels to be easily removable from the frame for increased ease in moving the underwater exercise invention to reorient it, as well as for more convenient storage thereof between uses.

The description herein provides preferred embodiments of the present invention but should not be construed as limiting the scope of the underwater aquacycle invention. For example, variations in the number of paddles used, the number of openings through the paddle support easing configured to receive a paddle locking button, the number of holes in the seat supporting member used for vertical adjustment of the seat, the length of each paddle, the materials from which the paddles are made, the dimension and configuration of the handles, the type of spring means used for the paddle locking buttons, the type of weight used to secure the frame in place during use, and the material from which the weight is made, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
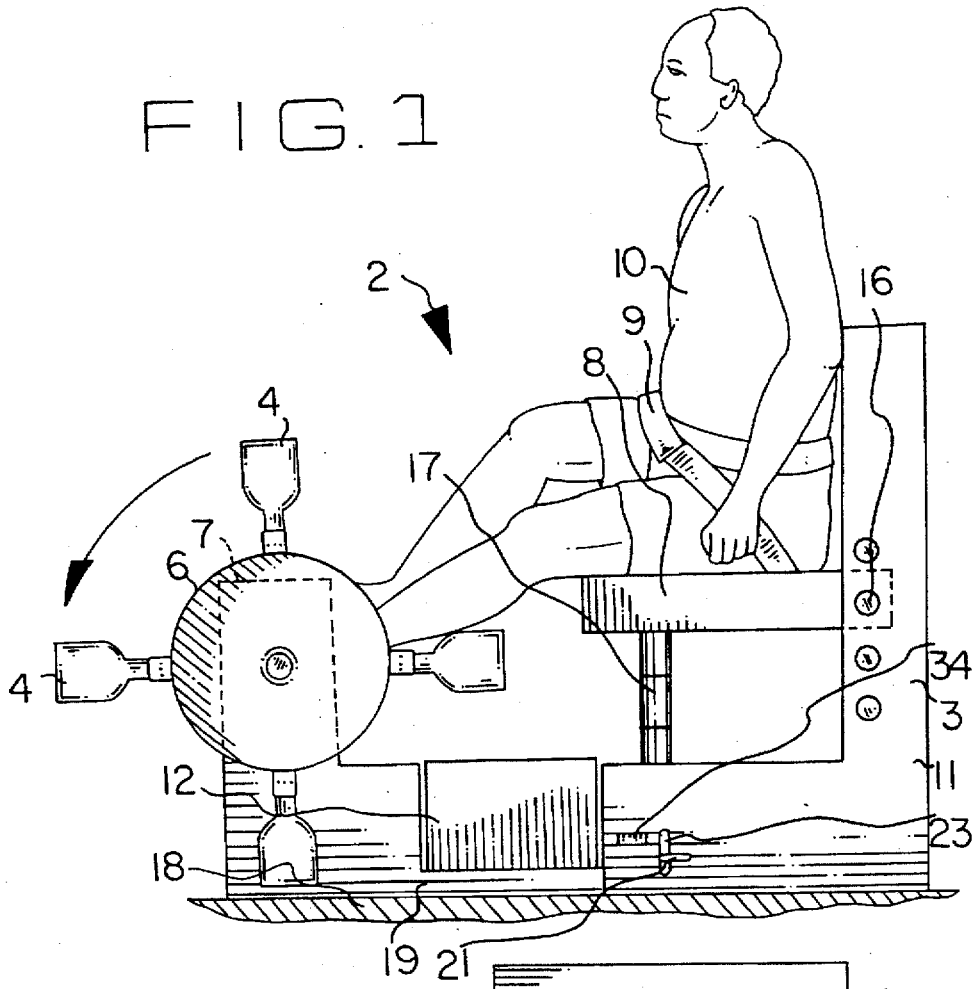
FIG. 1 is a side view of the invention in a first orientation so as to be positioned in the bottom of a body of water for exercise of muscles associated with an operator's lower extremities.

FIG. 1 shows a preferred embodiment of an underwater aquacycle invention 2 in a first orientation positioned for exercise of the lower extremities of an operator 10. FIG. 1 shows underwater aquacycle invention 2 having an essentially U-shaped frame composed of two connected L-shaped components. In FIG. 1, one L-shaped component has a wheel supporting portion 7 depending upwardly from one end of a stationary member 19. The other L-shaped component has a seat supporting member 3 upwardly depending from one end of a movable portion 11. In the preferred embodiment it is contemplated for movable portion 11 to be adjustable in length relative to stationary member 19 into several extended positions and a fully retracted position to accommodate operators 10 of differing stature. An adjustment handle 21, a slot 23 in which adjustment handle 21 is moved, and a pivot pin 34 are shown positioned between stationary member 19 and movable portion 11 as part of the means to adjust movable portion 11 relative to stationary member 19. Although not shown, it is contemplated to have a corresponding handle 21, a corresponding slot 23, and a corresponding pivot pin positioned on the opposite side of movable portion 11. FIG. 1 also shows stationary member 19 and movable portion 11 positioned against the bottom of a swimming pool 18. Although not shown, it is contemplated for underwater aquacycle invention 2 to be positioned within any other body of water sufficient to at least partially submerge wheel supporting portion 7. Underwater aquacycle invention 2 is secured into place against the bottom of swimming pool 18 by use of a weight 12 positioned within a recess in the upper surface of stationary member 19. The type of weight used is not critical to the present invention and it is equally contemplated to have weight 12 comprise a solid block of material as it is for weight 12 to comprise a sand bag. FIG. 1 shows operator 10 positioned on the upper surface of a seat 8 and attached to seat 8 with a seat belt 9. FIG. 1 also shows seat 8 connected to seat supporting member 3 so that seat 8 is approximately parallel to the bottom of swimming pool 18 during use, and in addition shows seat supporting member 3 having a plurality of holes 16 therethrough so that seat 8 can be vertically adjusted to accommodate operators of differing stature. The means of connecting seat belt 9 to seat 8, or to seat supporting member 3, is not critical to the present invention. Also, although the means for connection of seat 8 to U-shaped frame 3 is not critical and not shown, in the preferred embodiment it is contemplated for such connection to be accomplished by a quick release type of mechanism that can be easily handled by operator 10, such as a locking-type of pin. In addition, FIG. 1 shows seat 8 having a downwardly depending leg 17 which supports the front potion of seat 8 against the upper surface of movable portion 11. It is contemplated for leg 17 to be telescoping so as to be correspondingly adjustable in height as seat 8 is raised and lowered relative to seat supporting member 3. Although not shown, in the preferred embodiment it is contemplated for underwater aquacycle invention 2 to have at least two downwardly depending legs 17, for one leg 17 each to support a portion of seat 8 positioned under the legs of operator 10, and for each leg 17 to have a means to lock it into a fixed position after vertical adjustment of seat 8.

FIG. 1 further shows the central axis of a wheel 6 connected to wheel supporting portion 7 and having four paddles 4 attached around its perimeter which radially extend beyond the perimeter of wheel 6. Although not shown, it is contemplated for underwater aquacycle invention 2 to have two spaced-apart wheels 6 attached laterally to two wheel supporting portions 7 upwardly depending from stationary member 19. It is also contemplated for the connection of wheels 6 to wheel supporting potion 7 to be made so that wheels 6 are freely rotatable in both clockwise and counterclockwise directions. Also, although not shown, it is contemplated for wheels 6 to be removable from wheel supporting portion 7 for more efficient storage of underwater aquacycle invention 2 during periods of non-use. It is further contemplated for paddles 4 to be removable from each wheel 6 and for the orientation of paddles 4 relative to each wheel 6 to be variable so as to provide varying amounts of resistance to the muscles of operator 10 when paddles 4 are moved through water (not shown). Neither the dimension, nor the configuration, of paddles 4 is critical to the present invention and it is equally contemplated for paddles 4 to be planar in configuration or to be curved into scooping oar-type devices. It is contemplated for the orientation of paddles 4 to be set prior to use to independently establish the amount of resistance each wheel 6 would provide during exercise. The number of paddles 4 connected to each wheel 6 during each use of the present invention can also be varied. In the preferred embodiment it is contemplated for the U-shaped frame of underwater aquacycle invention 2, paddles 4, wheel 6, seat 8, and legs 17 to be either made from stainless steel for clinical use, or from injection molded plastic material for residential and recreational use, the plastic materials used being resistant to chemicals commonly used to treat swimming pool water (not shown). A plastic, or other lightweight material, is contemplated for the residential and recreational use embodiment of underwater aquacycle invention 2 to reduce the expense to the consumer, as well as make it lighter in weight and thereby more convenient for homeowners (not shown) to move underwater aquacycle invention 2 in and out of water between uses.

Figure 2:
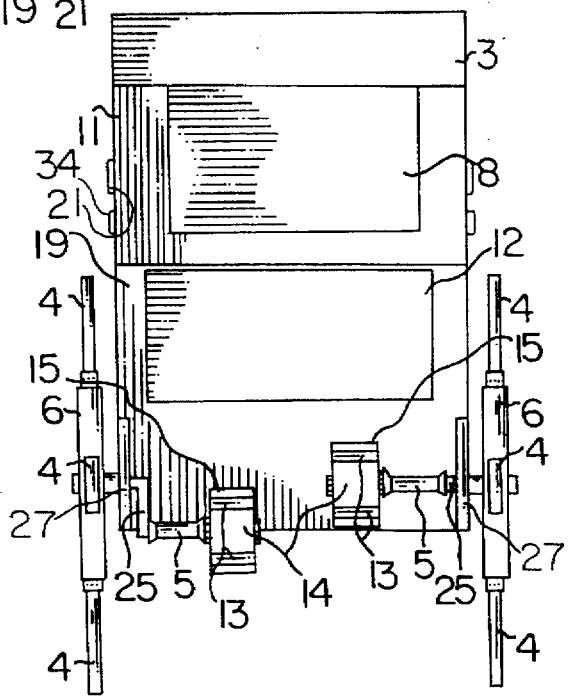
FIG. 2 is a top view of the first orientation of the invention.

FIG. 2 shows underwater aquacycle invention 2 having seat 8 positioned above movable portion 11, seat supporting member 3 positioned behind seat 8, and weight 12 positioned above stationary member 19 in a position forward to seat 8. Although FIG. 2 shows seat 8 and weight 12 both having a rectangular configuration, the shape and dimension of seat 8 and weight 12 are not critical to the present invention. Also, the materials from which weight 12 are made are not critical to underwater aquacycle invention 2, as long as weight 12 has sufficient density to anchor underwater aquacycle invention 2 in a stable fixed position on the bottom of swimming pool 18 during use. Although not shown, it is contemplated to have a means to lock weight 12 into the recess in stationary member 19 into which it is normally positioned. FIG. 2 also shows two wheels 6 laterally positioned forward to weight 12. A plurality of paddles 4 are attached to the perimeter of each wheel 6 in positions whereby each paddle 4 extends radially beyond the perimeter of one wheel 6. Between wheels 6, FIG. 2 shows a handle 5 connected to each wheel 6 by a crank 25. FIG. 2 also shows a pedal 14 depending centrally from each handle 5, a heel plate 15 on the rear portion of each pedal 14, and foot straps 13 positioned laterally across the forward portion of each pedal 14. A pillow block 27 is connected laterally on each side of stationary member 19 to support one crank 25 so that it is journaled for rotation. Although not shown, in the preferred embodiment of the present invention it is contemplated for foot straps 13 to be configured so as to allow the foot of operator 10 to achieve quick entry into, and quick release from, each pedal 14. In the preferred embodiment of the present invention it is contemplated to have a hook and pile type of fastener interconnecting both portions of a two-part foot strap 13 which would permit the contemplated quick entry and quick release of the feet of operator 10 from against pedals 14. It is also contemplated in the preferred embodiment for cranks 25 to position one combined handle 5 and pedal 14 unit in a position 180° opposed to the position of the other handle 5 and pedal 14 combination. FIG. 2 also shows adjustment handles 21 and pivot pins 34 positioned laterally on movable portion 11.

Figure 3:
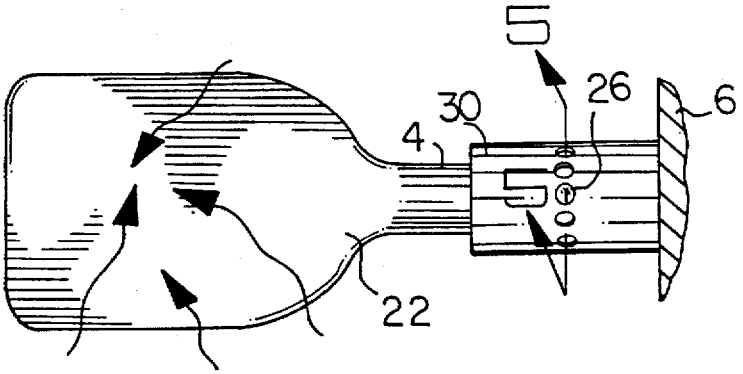
FIG. 3 is a side view of one of the invention paddles oriented in its vertical position of least resistance.
Figure 4:
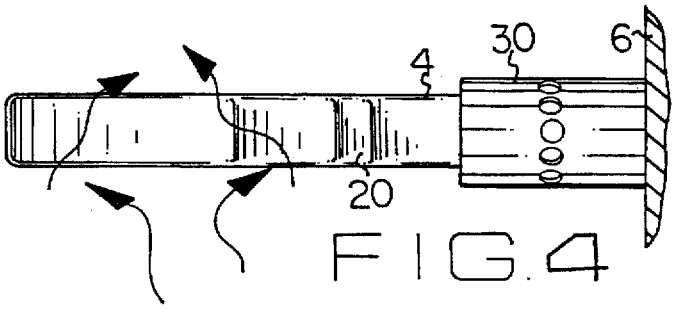
FIG. 4 is a side view of one of the invention paddles oriented in its horizontal position of greatest resistance.

FIG. 3 shows one paddle 4 oriented vertically in a position of least water resistance 22 and attached to one wheel 6, while FIG. 4 shows one paddle 4 oriented horizontally in a position of greatest water resistance 20 and attached to one wheel 6. The four arrows around each paddle 4 in FIGS. 3 and 4 show the direction of water flow around paddle 4 in position of least water resistance 22 and position of greatest water resistance 20, respectively. During use, as each wheel 6 revolves around its central axis, paddles 4 attached thereto periodically are caused to enter and exit through the surface of water in swimming pool 18. The positions of least and greatest water resistance, 22 and 20 respectively, are therefore defined to represent an orientation of paddles 4 upon their entry into and their exit from the water (not shown), which are when the plane of paddles 4 are perpendicular and parallel to the water's surface, respectively. FIGS. 3 and 4 also show paddle 4 connected to wheel 6 through use of a casing 30 having a plurality of openings 26 therethrough. Openings 26 permit paddles 4 to be positioned into a variety of orientations between position of least water resistance 22 and position of greatest water resistance 20. Although FIGS. 3 and 4 each shows several openings 26 through casing 30, the number of openings 26 used is not critical to the present invention.

Figure 5:
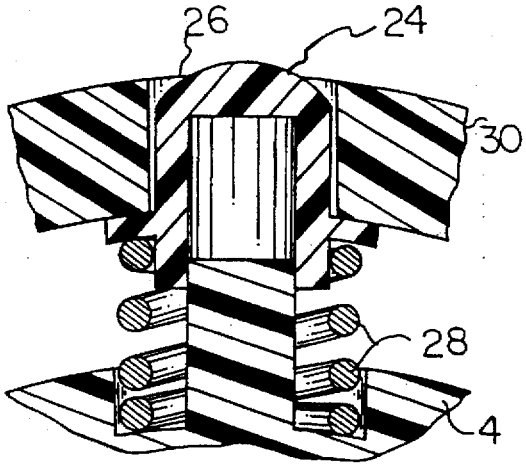
FIG. 5 is a enlarged sectional view along line 5—5 in FIG. 3 of a spring-biased paddle locking button positioned within an opening in a paddle support casing.

FIG. 5 shows a button 24 depending perpendicularly from the surface of paddle 4 and biased outwardly to engage opening 26 through casing 30. A coiled spring 28 is shown in FIG. 5 positioned between paddle 4 and the rear portion of button 24 as the means for outwardly biasing button 24 to engage opening 26. Although a coiled spring 28 is shown in FIG. 6, the type of spring means used is not critical to the present invention and other means of outwardly biasing button 24 to engage opening 26 are contemplated.

Figure 6:
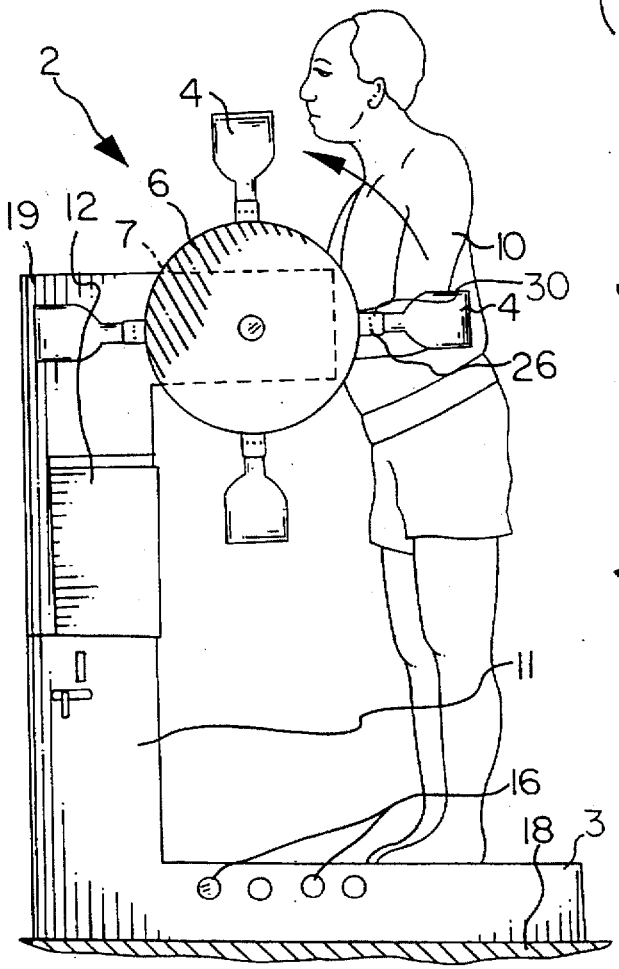
FIG. 6 is a side view of the invention in a second orientation rotated 90 degrees from the first orientation and positioned on the bottom of a body of water for exercise of muscles associated with an operator's upper extremities.

FIG. 6 shows underwater aquacycle invention 2 in a second orientation that is rotated ninety degrees from the first orientation shown in FIG. 1 and operator 10 standing on seat supporting member 3. The second orientation of underwater aquacycle invention 2 is for use in exercising the upper extremities of operator 10, with seat supporting member 3 positioned horizontally against the bottom of swimming pool 18 and movable portion 11 and stationary member 19 in vertical positions that are approximately perpendicular to the bottom of swimming pool 18. FIG. 6 also shows weight 12 positioned within a recess in stationary member 19 and one wheel 6, with paddles 4 connected thereto, attached to wheel supporting portion 7. FIG. 6 further shows openings 26 in each casing 30 for securely attaching each paddle 4 to wheel 6 and permitting a variety of orientations of each paddle 4 relative to the casing 30 supporting it. In addition, FIG. 6 shows seat supporting member 3 having holes 16 therethrough and seat 8 removed from its usable position.

Figure 7:
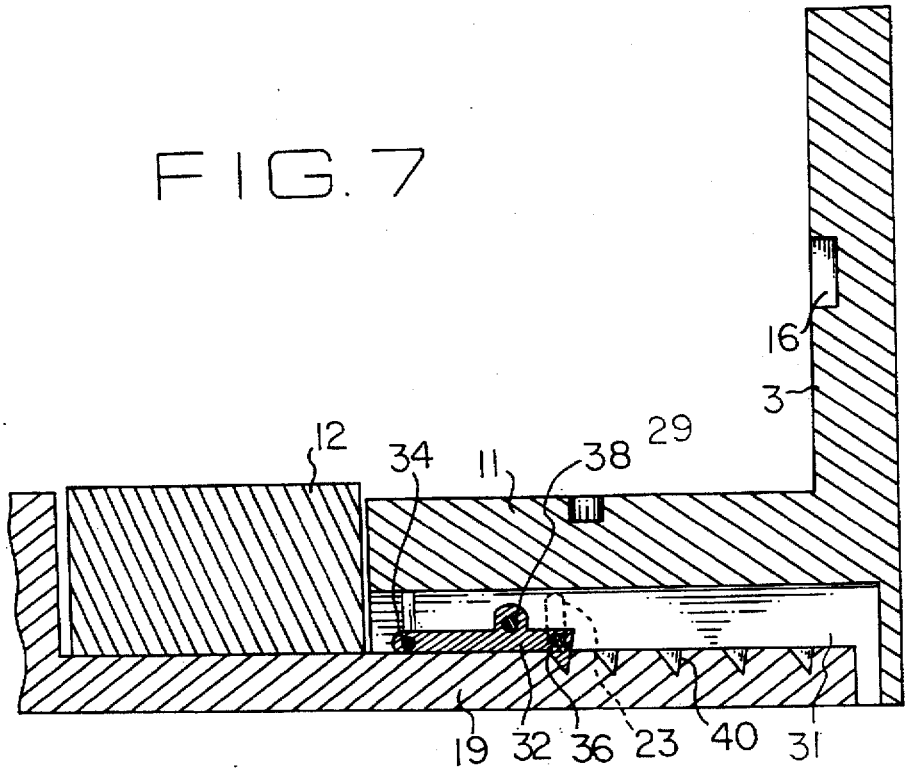
FIG. 7 is a partial sectional side view of the U-shaped frame of the invention in its first orientation and having its movable seat supporting section in a fully retracted position.

FIGS. 7, 8, 9, and 10 show the means by which movable portion 11 can be extended outwardly lengthwise from stationary member 19 and remain locked into position relative to stationary member 19 during operator's 10 use of underwater aquacycle invention 2. FIG. 7 shows movable portion 11 in a fully retracted position against stationary member 19. Movable portion 11 is positioned horizontally with seat supporting member 3 upwardly depending from one end of movable portion 11. FIG. 7 also shows hole 16 within seat supporting member 3 and a leg receiving hole 29 positioned in the upper surface of movable portion 11. Weight 12 is positioned against the upper surface of stationary member 19 and a part of stationary member 19 is positioned within a cavity 31 in movable portion 11. Several triangular indentations 40 are positioned within cavity 31 at uniformly spaced-apart distances from one another on the upper surface of the part of stationary member 19 within cavity 31. FIG. 7 further shows a securing device 32 having a triangular protrusion 36 downwardly depending therefrom positioned and resting against the upper surface of stationary member 19, with triangular protrusion 36 inserted into one triangular indentation 40 to lock the position of movable portion 11 relative to stationary member 19. FIG. 7 also shows a pivot pin 34 on the end of securing device 32 remote from triangular protrusion 36 and a securing pin 38 centrally located through securing device 32 for attaching securing device 32 to movable portion 11. It is contemplated for securing pin 38 to be removed during movement of triangular protrusion into a new triangular indentation 40 when adjusting the length of underwater aquacycle invention 2. Slot 23 is shown where it would be positioned through the side of movable portion 11 to allow adjusting handle 21 to be positioned therethrough so that one end of adjusting handle 21 is connected to securing device 32 and the other of its ends is available for use by operator 10 to extend and retract movable portion 11 relative to stationary member 19.

Figure 8:
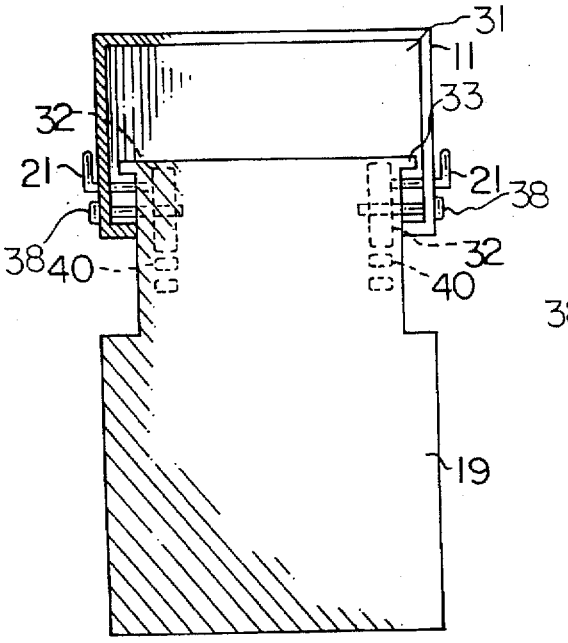
FIG. 8 is a bottom view of the U-shaped frame of the invention having its movable seat supporting member in an extended position.
Figure 9:
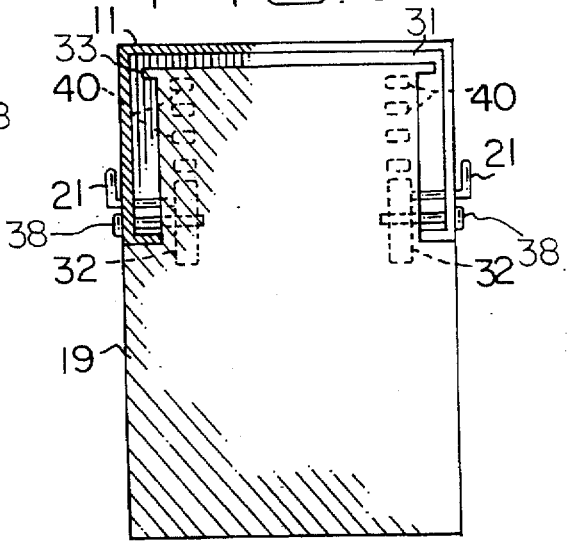
FIG. 9 is a bottom view of the U-shaped frame of the invention having its movable seat supporting member in a fully retracted position.

FIGS. 8 and 9 show stationary member 19 positioned within cavity 31 in movable portion 11. FIG. 8 shows movable portion 11 in an extended position relative to stationary member 19, while FIG. 9 shows movable portion 11 in a fully retracted position relative to stationary member 19. The end of stationary member 19 moving within cavity 31 is shown to have stops 33 laterally depending therefrom and the distal ends of each side of movable portion 11 are shown to bend inwardly toward one another to retain stops 33 and keep movable portion 11 from becoming inadvertently separated from stationary member 19 when securing pins 38 are removed. FIGS. 8 and 9 also show a securing device 32 on each side of movable portion 11 with one adjusting handle 21 attached to each securing device 32, each adjusting handle 21 inserted laterally through movable portion 11, one securing pin 38 connected through each side of movable portion 11, and the relative positions of triangular indentations 40 and securing device 32 to adjusting handles 21 and securing pins 38.

Figure 10:
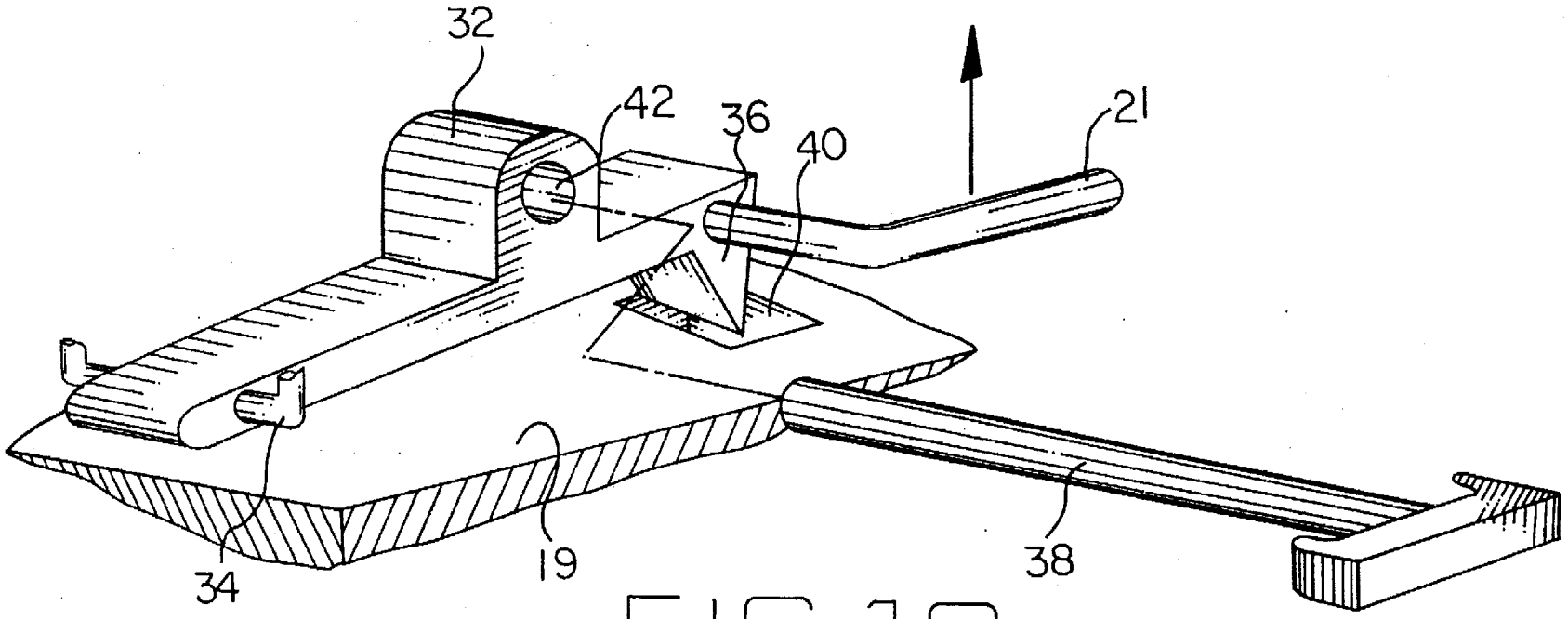
FIG. 10 is a perspective view of the mechanism of the invention used to move and secure the movable seat supporting member of the invention between extended positions and a fully retracted position.

FIG. 10 shows pivot pin 34 attached the end of securing device 32 remote from triangular protrusion 36 for connecting securing device to movable portion 11. FIG. 10 also shows triangular protrusion 36 positioned above one triangular indentation 40 in the upper surface of stationary member 19. Although adjusting handle 21 is shown attached to the end of securing device 32 remote from pivot pin 34 in a position above triangular protrusion 36, such positioning is not critical as long as adjusting handle 21 is positioned near to triangular protrusion 36. Also, removable securing pin 38 is shown positioned for insertion into an aperture 42 in securing device 32. The configuration and dimension of securing pin 38 is not critical to the present invention, nor is the configuration and dimension of adjusting handle 21.

To use underwater aquacycle invention 2 in swimming pool 18 to exercise muscles associated with the lower extremities of operator 10, the U-shaped frame of underwater aquacycle invention 2 would be positioned so that stationary member 19 and movable potion 11 are positioned against the bottom of swimming pool 18. Removable weight 12 would be placed against the upper surface of stationary member 19 to securely anchor underwater aquacycle invention 2 into a fixed position during use. Operator 10 would attach seat 8 to seat supporting member 3 and sit thereon during exercise with seat belt 9 retaining operator 10 in place upon seat 8 during lower extremity muscle movement to rotate wheels 6. Holes 16 through seat 8 and seat supporting member 3 would allow seat 8 to be vertically adjustable to accommodate operators 10 of differing stature, as well as to offer each operator 10 a range of leg extension and movement. Also, movable potion 11 can be extended or retracted relative to stationary member 19 to place wheel 6 in the best position for use by operator 10. For such extension or retraction, operator 10 would remove securing pin 38 from aperture 42, then move adjusting handle 21 away from stationary member 19 to move triangular protrusion 36 out of its corresponding triangular indentation 40. Once triangular protrusion 36 is lifted therefrom, operator 10 can move movable portion 11 inwardly or outwardly relative to stationary member 19, move adjusting handle 21 downward to place triangular protrusion 36 into a new triangular indentation 40, and then replace securing pin 38 into aperture 42 to secure securing device 32 into its new position.

During exercise, the feet of operator 10 would be secured against pedals 14 with foot straps 13 for movement of each wheel 6 in both clockwise and counterclockwise directions. As the resistance of wheels 6 need to be varied to meet changing needs of operator 10, the orientation of one or more paddles 4 can be individually changed relative to each wheel 6 to offer operator 10 increased or decreased resistance. The orientation of paddles 4 are changeable through the use of locking buttons 24 and engagement thereof with openings 26 in casings 30. As the plane of each paddle 4 is positioned so as to become more parallel to the water's surface upon entry therein, resistance of the present invention is increased. As the plane of each paddle 4 is positioned so as to become more perpendicular to the water's surface upon entry therein, resistance of the present invention is decreased. After exercise of muscles associated with his or her lower extremities, should operator 10 want to exercise muscles associated with upper extremities, operator 10 would remove weight 12 from stationary member 19, rotate underwater aquacycle invention 2 ninety degrees so that stationary member 19 and movable portion 11 are positioned vertically and seat supporting member 3 is positioned horizontally against the bottom of swimming pool 18. After seat 8 is removed and weight 12 is replaced in position against stationary member 19, and secured thereto, operator 10 can stand upon seat supporting member 3 and grip one or both handles 5, each handle 5 being independently attached by one crank 25 to one wheel 6, and with his or her hands operator 10 can cause one or both wheels 6 to rotate about its central axis. Pedals 14 can be separated from handles 5 and removed should operator 10 so desire during use of handles 5. Both wheels 6 are removable from wheel supporting portion 7 for increased ease in moving underwater aquacycle invention 2 into and out of swimming pool 18 and for more convenient storage of underwater aquacycle invention 2 between uses.

What is claimed is:

1. An underwater exercise device for exercising muscles associated with both the lower extremities and the upper extremities of an operator, said device comprising an essentially U-shaped frame having two L-shaped components movable lengthwise relative to one another, one of said L-shaped components being a seat supporting member and the other of said L-shaped components being a wheel supporting portion; each of said L-shaped components having an upwardly depending end; a first fixing means connected between said L-shaped components to allow said L-shaped components to move relative to one another for lengthwise adjustment and to securely connect said L-shaped components to one another after said lengthwise adjustment; a pair of wheels each having a central axis and a perimeter; said central axis of each of said wheels being connected laterally to said upwardly depending end of said wheel supporting portion so that said wheels can move in both clockwise and counterclockwise directions; a plurality of paddles, each of said paddles being removably connected to said perimeter of one of said wheels in a position to radially extend beyond said perimeter; a first connection means to position each of said paddles into a variety of fixed orientations between a first position of maximum resistance and a second position rotated ninety degrees therefrom and creating minimum resistance during movement through water; a pair of handles, one of said handles being connected for rotation to each of said wheels in a position between said wheels; a pair of pedals, each of said pedals being connected to one of said handles and positioned centrally between said handles; a second connection means to connect one of said pedals and one of said handles to each of said wheels; a seat removably connected to said upwardly depending end of said seat supporting member, said seat being configured to comfortably support an adult human operator; restraining means for use with said seat to maintain an operator against said seat during movement of said wheels; a third connection means to adjustably connect said seat to said seat supporting member so that said seat may be adjusted vertically; and weighted means positioned against said frame to anchor said frame in place under water so that at least part of said wheels and said paddles remain underwater during exercise, and so that said device provides water resistance to muscles associated with the lower extremities of an operator when said device is oriented in water so that said upwardly depending ends of said L-shaped components are positioned perpendicular to the bottom surface of a body of water, said seat is connected to said frame, the operator is positioned upon said seat, and the operator's feet are used against said pedals to cause rotation of said wheels, and so that said device also provides water resistance to muscles associated with the upper extremities of an operator when said device is oriented in water so that said upwardly depending ends of said L-shaped components are positioned parallel to the bottom surface of the water, said seat is removed from said frame, the operator is standing upon said upwardly depending end of said seat supporting member so as to face said wheels, and the operator's hands are used to grip said handles to cause rotation of said wheels.

2. The underwater exercise device of claim 1 wherein said first connection means comprises a plurality of casings attached to each of said wheels, a plurality of openings through each of said casings, and a plurality of locking buttons, each of said paddles having at least one of said locking buttons attached thereto for engagement with one of said openings and orientation of said paddles into fixed positions relative to said casings during exercise use.

3. The underwater exercise device of claim 2 further comprising spring means associated with each of said locking buttons to outwardly bias each of said locking buttons into an extended position.

4. The underwater exercise device of claim 1 wherein said second connection means comprises a pair of cranks and a pair of pillow blocks, each of said cranks and one of said pillow blocks being used to connect one of said pedals and one of said handles to one of said wheels, said pillow blocks each being positioned and configured to journal one of said wheels for rotation upon movement of said pedals and handles by an operator's feet and hands, respectively.

5. The underwater exercise device of claim 1 wherein each of said pedals are removably connected to one of said handles.

6. The underwater exercise device of claim 1 wherein said third connection means comprises a plurality of holes through said seat supporting member, a plurality of holes through said seat configured to correspond to said holes through said seat supporting member, a plurality of legs downwardly depending from said seat, and a second fixing means attached between said seat and said seat supporting member for securing said seat into one of several preselected fixed positions relative to said seat supporting member during exercise.

7. The underwater exercise device of claim 1 wherein said first fixing means comprises at least two securing devices each having an aperture centrally therethrough, opposite ends, a downwardly projecting triangular protrusion on one of said opposite ends, and a pivot pin attached to the other of said opposite ends, said pivot pin also being connected to the one of said L-shaped components acting as a seat supporting member; said first fixing means also comprising a plurality of triangular indentations in the upper surface of the one of said L-shaped members acting as a wheel supporting portion, an adjusting handle having opposed ends, one of said opposed ends being attached to the one of said opposite ends of said securing device from which said triangular protrusion depends and attached thereto in a position above said triangular protrusion, and the other of said opposed ends of said adjusting handle being usable by an operator to lift said securing device away from said wheel supporting portion to selectively remove said triangular protrusion from one of said triangular indentations and move said seat supporting member lengthwise relative to said wheel supporting portion, and thereafter replace said triangular protrusion into another of said triangular indentations to fix the position of both of said L-shaped components relative to one another; said first fixing means further having at least two securing pins, each of said securing pins being inserted through said seat supporting member and also inserted into said aperture in one of said securing devices to prevent each of said triangular protrusions from becoming removed from the one of said triangular indentations into which it is selectively inserted during use of said underwater exercise device by an operator.

8. An underwater exercise device for exercising muscles associated with both the lower extremities and the upper extremities of an operator, said device comprising an essentially U-shaped frame having two L-shaped components movable lengthwise relative to one another, one of said L-shaped components being a seat supporting member and the other of said L-shaped components being a wheel supporting portion, each of said L-shaped components having an upwardly depending end; a first fixing means connected between said L-shaped components to allow said L-shaped components to move relative to one another for lengthwise adjustment and to securely connect said L-shaped components to one another after said lengthwise adjustment; a pair of wheels each having a central axis and a perimeter; said central axis of each of said wheels being connected to said upwardly depending end of said wheel supporting portion so that said wheel can move in both clockwise and counterclockwise directions; a plurality of paddles, each of said paddles being removably connected to said perimeter of one of said wheels in a position to radially extend beyond said perimeter; a first connection means to position each of said paddles into a variety of fixed orientations between a first position of maximum resistance and a second position rotated ninety degrees therefrom and creating minimum resistance during movement through water, said first connection means comprising a plurality of casings attached to each of said wheels, a plurality of openings through each of said casings, and a plurality of locking buttons, each of said paddles having at least one of said locking buttons attached thereto for engagement with one of said openings and orientation of said paddles into fixed positions relative to said casings during exercise use; a pair of handles, one of said handles being connected for rotation to each of said wheels in a position between said wheels; a pair of pedals, each of said pedals being connected to one of said handles and positioned centrally between said handles; a second connection means to connect one of said pedals and one of said handles to each of said wheels, said second connection means comprising a pair of cranks and a pair of pillow blocks, each of said cranks and one of said pillow blocks being used to connect one of said pedals and one of said handles to one of said wheels, said pillow blocks each positioned and configured to journal one of said wheels for rotation upon movement of said pedals and handles by an operator's feet and hands, respectively; a seat removably connected said upwardly depending end of said seat supporting member, said seat being configured to comfortably support an adult human operator; restraining means for use with said seat to maintain an operator against said seat during movement of said wheels; a third connection means to adjustably connect said seat to said frame so that said seat may be adjusted vertically, said third connection means comprising a plurality of holes through said seat supporting member, a plurality of holes through said seat configured to correspond to said holes through said seat supporting member, a plurality of legs downwardly depending from said seat, and a second fixing means attached between said seat and said seat supporting member for securing said seat into one of several pre-selected fixed positions relative to said seat supporting member during exercise so that said seat can be vertically adjusted; and weighted means positioned against said frame to anchor said flame in place under water so that at least part of said wheels and said paddles remain underwater during exercise, and so that said underwater exercise device provides water resistance to muscles associated with the lower extremities of an operator when said device is oriented in water so that said upwardly depending ends of said U-shaped frame is positioned perpendicular to the bottom surface of a body of water, said seat is connected to said frame, the operator is positioned upon said seat, and the operator's feet are used against said pedals to cause rotation of said wheels, and so that said device also provides water resistance to muscles associated with the upper extremities of an operator when said device is oriented in water so that said upwardly depending ends of said U-shaped frame are positioned parallel to the bottom surface of the water, said seat is removed from said frame, the operator is standing upon said one of said upwardly depending ends so as to face said wheels, and the operator's hands are used to grip said handles to cause rotation of said wheels.

9. The underwater exercise device of claim 8 further comprising spring means associated with each of said locking buttons to outwardly bias each of said locking buttons into an extended position.

10. The underwater exercise device of claim 8 wherein each of said pedals are removably connected to one of said handles.

11. The underwater exercise device of claim 8 wherein said first fixing means comprises at least two securing devices each having an aperture centrally therethrough, opposite ends, a downwardly projecting triangular protrusion on one of said opposite ends, and a pivot pin attached to the other of said opposite ends, said pivot pin also being connected to the one of said L-shaped components acting as a seat supporting member; said first fixing means also comprising a plurality of triangular indentations in the upper surface of the one of said L-shaped members acting as a wheel supporting portion, an adjusting handle having opposed ends, one of said opposed ends being attached to the one of said opposite ends of said securing device from which said triangular protrusion depends and attached thereto in a position above said triangular protrusion, and the other of said opposed ends of said adjusting handle being usable by an operator to lift said securing device away from said wheel supporting portion to selectively remove said triangular protrusion from one of said triangular indentations and move said seat supporting member lengthwise relative to said wheel supporting portion, and thereafter replace said triangular protrusion into another of said triangular indentations to fix the position of both of said L-shaped components relative to one another; said first fixing means further having at least two securing pins, each of said securing pins being inserted through said seat supporting member and also inserted into said aperture in one of said securing devices to prevent each of said triangular protrusions from becoming removed from the one of said triangular indentations into which it is selectively inserted during use of said underwater exercise device by an operator.

12. A method for exercising muscles associated with the upper and lower extremities of an operator, said method comprising the steps of providing a first L-shaped component having a seat supporting member on one of its ends, a second L-shaped component having a wheel supporting portion on one of its ends, a seat, a pair of wheels, a plurality of casings, a plurality of paddies, a pair of pedals, a pair of handles, and a weight; connecting said first L-shaped component and said second L-shaped component to make a U-shaped frame; positioning said U-shaped frame within a body of water so that said wheel supporting portion and said seat supporting member are perpendicular to the bottom of the body of water; placing said weight against said U-shaped frame to anchor said U-shaped frame into a fixed position during use; attaching said seat to said seat supporting member; attaching one end of each of said casings to one of said wheels; positioning one end of each of said paddles within one of said casings; orienting each of said paddies relative to said casings to provide a desired amount of resistance when said paddies are moved through the body of water; attaching one of said handles to each of said wheels; removably connecting one of said pedals to each of said handles; attaching each of said wheels laterally to one of said wheel supporting portions so that said pedals are centrally positioned between said wheels and so that when an operator is positioned upon said seat the operator's feet can be used against said pedals to move said wheels for exercise of muscles associated with the operator's lower extremities; and thereafter upon rotating said frame approximately ninety degrees so that said seat supporting member is positioned against the bottom surface of said body of water, and after disengaging and removing said seat from said U-shaped frame, an operator can stand upon said seat supporting member and the operator's hands can grip said handles to rotate said wheels in both clockwise and counterclockwise directions for exercise of muscles associated with the operator's upper extremities.

* * * * *